US011499307B2

(12) United States Patent
Spampatti et al.

(10) Patent No.: US 11,499,307 B2
(45) Date of Patent: Nov. 15, 2022

(54) SYSTEMS AND METHODS FOR A CAST-IN ANCHOR

(71) Applicant: Hilti Aktiengesellschaft, Schaan (LI)

(72) Inventors: Matteo Spampatti, Addison, TX (US); Marc Schaeffer, Altendorf (CH); Philipe Simek, Lantana, TX (US)

(73) Assignee: Hilti Aktiengesellschaft, Schaan (LI)

( * ) Notice: Subject to any disclaimer, the term of this patent is extended or adjusted under 35 U.S.C. 154(b) by 314 days.

(21) Appl. No.: 16/652,164

(22) PCT Filed: Oct. 5, 2018

(86) PCT No.: PCT/EP2018/077091
§ 371 (c)(1),
(2) Date: Mar. 30, 2020

(87) PCT Pub. No.: WO2019/068849
PCT Pub. Date: Apr. 11, 2019

(65) Prior Publication Data

US 2020/0248444 A1 Aug. 6, 2020

Related U.S. Application Data

(60) Provisional application No. 62/606,716, filed on Oct. 6, 2017.

(51) Int. Cl.
*E04B 1/41* (2006.01)
*E04G 15/04* (2006.01)

(52) U.S. Cl.
CPC ..... *E04B 1/4121* (2013.01); *E04G 15/04* (2013.01)

(58) Field of Classification Search
CPC ..... E04B 1/4121; E04B 1/4171; E04G 15/04
USPC ..... 248/231.91
See application file for complete search history.

(56) References Cited

U.S. PATENT DOCUMENTS

| | | | | |
|---|---|---|---|---|
| 3,509,670 | A | 5/1970 | Boll et al. | |
| 3,884,004 | A * | 5/1975 | Douma | E04B 1/4171 52/309.9 |
| 4,211,048 | A * | 7/1980 | Naka | E04B 1/4121 52/700 |
| 9,303,399 | B2 * | 4/2016 | Espinosa | E04B 1/4121 |
| 9,394,706 | B2 * | 7/2016 | Lin | E04B 9/18 |
| 10,151,102 | B2 | 12/2018 | Mahrenholtz et al. | |

(Continued)

FOREIGN PATENT DOCUMENTS

| | | |
|---|---|---|
| JP | H02-27405 U | 2/1990 |
| JP | 2001-73467 | 3/2001 |
| JP | 2009-197424 | 9/2009 |

OTHER PUBLICATIONS

International Search Report dated Dec. 18, 2018 in PCT/EP2018/077091.
Written Opinion dated Dec. 18, 2018 in PCT/EP2018/077091.

*Primary Examiner* — Beth A Stephan
(74) *Attorney, Agent, or Firm* — Grüneberg and Myers, PLLC

(57) ABSTRACT

A system includes an anchor body, having a head and a hollow chamber shaft coupled to the head. The system includes a housing component configured to support the anchor body. The system also includes one or more fasteners supported by the housing component. At least one of the fasteners is coupled to the head of the anchor body, and an apex of each fastener is positioned to be above the head of the anchor body.

20 Claims, 2 Drawing Sheets

(56) References Cited

U.S. PATENT DOCUMENTS

| | | | | |
|---|---|---|---|---|
| 10,519,648 | B2 * | 12/2019 | Mahrenholtz | E04B 1/4171 |
| 10,760,733 | B2 * | 9/2020 | Schramm | E04B 1/4121 |
| 2017/0022701 | A1 | 1/2017 | Espinosa | |
| 2018/0163392 | A1 * | 6/2018 | Spampatti | E04B 1/4157 |
| 2018/0187412 | A1 * | 7/2018 | Espinosa | E04B 1/4121 |
| 2019/0093337 | A1 * | 3/2019 | Cabaj | F16B 13/06 |

* cited by examiner

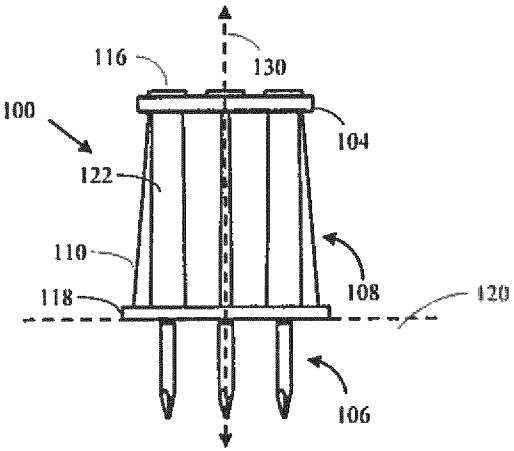
FIG. 1
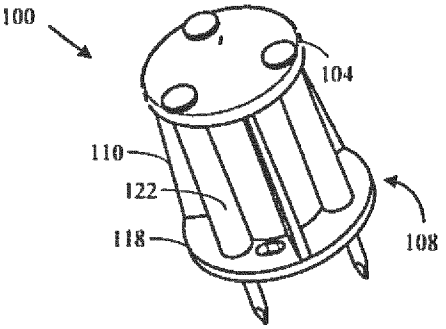
FIG. 2
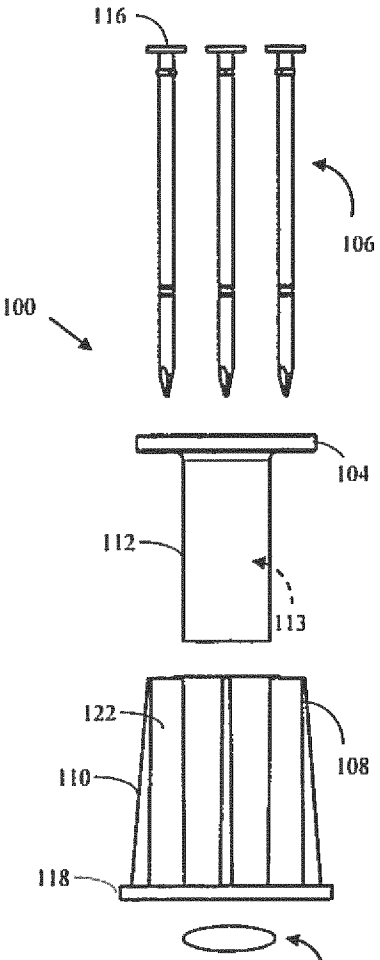
FIG. 3
FIG. 4
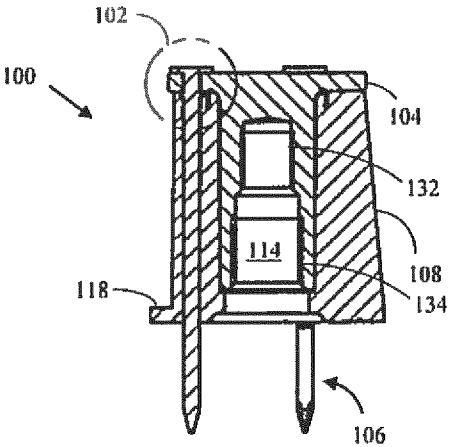
FIG. 5

SYSTEMS AND METHODS FOR A CAST-IN ANCHOR

CROSS-REFERENCE TO RELATED APPLICATIONS

This application is a National Stage entry under § 371 of International Application No. PCT/EP2018/077091, filed on Oct. 5, 2018, and which claims the benefit of U.S. Application No. 62/606,716, filed on Oct. 6, 2017. The contents of each of these applications is hereby incorporated by reference in their entirety.

BACKGROUND

The present disclosure relates generally to the field of anchoring systems, and more particularly to anchoring systems assembled within a concrete deck. Specifically, the present embodiments are related to anchoring systems that are utilized to fasten various construction elements to the concrete deck.

In typical construction sites, deck construction (e.g., decking) is often utilized to build the floors and ceilings of multiple story buildings. In such buildings, anchoring systems may be installed to suspend various construction elements (e.g., pipes, sprinkler systems, HVAC components, conduits, electrical elements, etc.) from the ceiling. In certain situations, the anchoring systems may be positioned during the construction of the deck, before concrete is poured. For example, a wood form, a fluted, and/or a corrugated metal sheet of alternating peaks and valleys may be installed as a base. Further, various anchoring systems are positioned throughout the deck based on the desired function and position of the construction elements that the anchoring systems are configured to support within the building. After the anchoring systems are properly positioned in the base, concrete is poured over the base, thereby securing and embedding the anchoring system. After formation of the deck (e.g., the floors and ceilings of the building), a male or female connection may be threaded into the anchoring system to securely suspend or fasten the construction element from the ceiling.

In certain situations, the anchoring systems (or a feature of the anchoring system) may be dislodged or displaced after positioned throughout the deck and before the concrete is poured. For example, after an anchoring system is positioned on the deck, various activities around the job site (e.g., individuals walking around, concrete pouring, concrete vibrations, etc.) may lead to accidental displacement of the anchoring systems. Further, in certain situations, user error while positioning the anchoring system into the deck may cause deformation of various features of the anchoring system. Furthermore, in certain situations, concrete may ingress into the anchoring system while it is poured, thereby hindering the desired functionality of the anchor system. Accordingly, it may be beneficial to design an anchoring system that improves these and other concerns.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system is provided. The system includes an anchor body having a head and a hollow chamber shaft coupled to the head. The system includes a housing component configured to support the anchor body. The system includes one or more fasteners supported by the housing component. At least one of the fasteners is coupled to the head of the anchor body, and an apex of each fastener is positioned to be above the head of the anchor body.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein:

FIG. 1 is a side-view of an embodiment of a cast-in anchor having a press-fit interference between a head of the cast-in anchor and one or more fasteners;

FIG. 2 is a perspective view of an embodiment of the cast-in anchor of FIG. 1, where the cast-in anchor includes a housing having one or more ribs;

FIG. 3 is an exploded view of an embodiment of the cast-in anchor of FIG. 1, where the cast-in anchor includes a removable barrier component;

FIG. 4 is a side-view of an embodiment of the cast-in anchor of FIG. 1, where the head of the cast-in anchor contacts the housing;

FIG. 5 is a cross-sectional view of an embodiment of the cast-in anchor of FIG. 1, where the cast-in anchor includes a multi-thread component;

DETAILED DESCRIPTION

Figure 7:
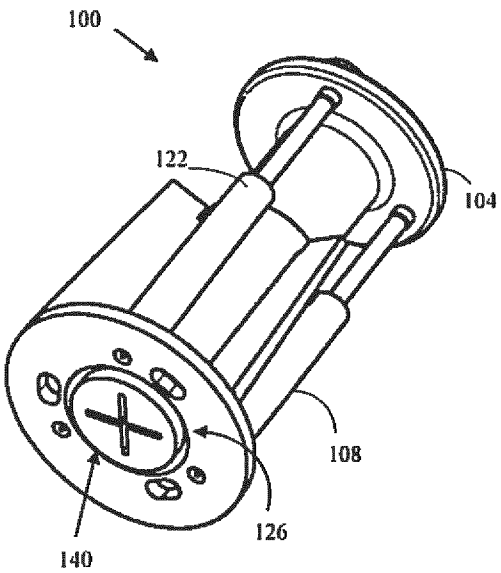
FIG. 7 is a perspective view of an embodiment of the cast-in anchor of FIG. 1, where the cast-in anchor includes a removable barrier component.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Present embodiments are directed to anchoring systems, and more specifically, for anchoring systems utilized in decks during the construction of floors and ceilings of multistory buildings. Specifically, the present embodiments are directed to a single-point cast-in anchor system (e.g., cast-in anchor system) that is configured to improve efficiency and reduce user-error during deck construction. For example, in certain embodiments, the cast-in anchor system may be pre-installed in a wood form before concrete is poured, and after the wood form is removed, a construction element may be coupled to the cast-in anchor system. The cast-in anchor system of the present embodiments may be configured to suspend construction elements (e.g., pipes, conduits, threaded rods, bolts, connectors, etc.) from the deck for various mechanical, electrical, plumbing, and other applications. In particular, the cast-in anchor system of the present embodiments may help reduce accidental displacement after being positioned on the deck and before concrete is poured. Indeed, as further described in detail below, the present embodiments are generally related to a cast-in anchor system having one or more design features that improve the efficiency and reduce the possible user-error during this installation process.

In certain embodiments, the cast-in anchor includes a housing component, an anchor body configured to mate with the housing component, a plurality of fasteners, and a barrier component. In certain embodiments, the plurality of fasteners are nails. In certain embodiments, the anchor body includes a head and a hollow chamber having a multi-thread component. The multi-thread component may include one or more continuous thread of different sizes, and may be configured to receive a threaded connection. Further, in certain embodiments, the anchor body is configured to be flush with the housing component. The housing component may provide support for the anchor body when positioned on the deck, and may include one or more features that prevent the flow of concrete into spaces around the anchor body. For example, in certain embodiments, the cast-in anchor includes a fixed or a removable barrier component. In certain embodiments, the housing component may be a plastic sleeve having one or more ribs that are positioned to provide the cast-in anchor with increased stability and stiffness.

In certain embodiments, each nail of the plurality of nails are positioned through the head, such that an apex of each nail is above the head of the anchor body. In particular, the position of the plurality of nails in this manner may help increase stability and stiffness of the cast-in anchor. For example, the position of the plurality of nails relative to the head of the anchor body may reduce instances where the head is dislodged from the anchor body on the construction site. Indeed, such an arrangement may help directly lock the cast-in anchor to the positioned location on the base before concrete is poured, so that one or more components of the cast-in anchor are not dislodged or displaced. In the illustrated embodiments, the plurality of nails may be coupled to head of the anchor body via a press-fit interference. However, it should be noted that in other embodiments or configurations, each nail of the plurality of nails may have an interlock relationship, a welded relationship, and/or any other type of interaction with the head of the anchor body. Indeed, it should be noted that any type of technique known in the art may be utilized to couple the head of each nail to the head of the anchor body, including, for example, an adhesive coating, a mechanical coupling, a male/female coupling, notching or other types of protrusions, recesses or other interlocking methods, threaded connections, or any other form of connection. In the illustrated embodiments having a press-fit interference, when the cast-in anchor is installed within the base (e.g., cast-in anchor is hammered into the base), striking any one of the nails may result in driving all of the nails and the anchor body into the base at the same time.

With the forgoing in mind, FIG. 1 is a side-view of an embodiment of a cast-in anchor 100 having a press-fit interference 102 between a head 104 of the cast-in anchor 100 and one or more fasteners 106. In certain embodiments, the cast-in anchor 100 includes a housing 108 comprising one or more ribs 110. The head 104 of the cast-in anchor is coupled to an anchor body 112 that is configured to be flush against the housing 108. In certain embodiments, the anchor body 112 may include a hollow chamber shaft 113 that includes a multi-thread component 114 (as illustrated in FIG. 5) having one or more continuous thread of different sizes. In certain embodiments, the one or more fasteners 106 are each configured to pass through the head 104 of the cast-in anchor 100, and through the housing 108. In particular, each fastener 106 of the plurality of fasteners 106 are positioned through the head 104 such that an apex 116 of each fastener 106 is above the head 104 of the anchor body 112, as further described in detail below.

As illustrated in FIG. 1, prior to installation on the wood form, the head 104 of the cast-in anchor 100 is above the housing 108, such that a base 118 of the housing 108 may be disposed flat against the wood form of the metal deck during the installation process. Specifically, as noted above, the cast-in anchor 100 may be pre-installed in a wood form 120 before concrete is poured, and after the wood form 120 is removed, a construction element may be coupled to the cast-in anchor 100. During the installation process, when the cast-in anchor 100 is hammered into the wood form 120, striking any one of the fasteners 106 or the head 104 may result in driving all of the fasteners 106 and the head 104 into the wood form 120 at the same time.

FIG. 2 is a perspective view of an embodiment of the cast-in anchor 100 of FIG. 1, where the cast-in anchor 100 includes the housing 108 having one or more ribs 110. In certain embodiments, the cast-in anchor 100 may include one or more ribs 110 on the housing 108 that are configured to help increase stability and anchor stiffness. The ribs 110 may run along a length of the housing 108, but may be angled out to create a wing between the top of the housing 108 and the base 118 of the housing 108. In certain embodiments, the ribs 110 may protrude from the surface of the housing 108 by varying lengths along the length of the anchor body 112. In certain embodiments, the ribs 110 may protrude from the surface of the housing 108 by a uniform amount along the length of the anchor body 112. In particular, the ribs 110 of the cast-in anchor 100 may be configured to reduce an amount of deflection and increase cast-in anchor 100 stiffness, at least in part because the ribs 110 reduce the flexibility of the base 118 (e.g., bending of the base 118) of the housing 108. Indeed, the ribs 110 of the cast-in anchor 100 absorb impact energy and help to deflect the impact throughout the cast-in anchor 100.

In certain embodiments, the cast-in anchor includes one or more channels 122 that are configured to receive the length of the fasteners 106. Specifically, each fastener 106 may be associated with a channel 122 that runs the length of the housing 108. In certain embodiments, the channel 122 may be configured to provide support and stability as the fastener 106 is guided through the housing 108 and into the wood form 120. Furthermore, similar to the ribs 110, each of the channels 122 may be configured to provide additional stability to the cast-in anchor by increasing anchor stiffness and absorbing impact energy to help deflect the impact through the cast-in anchor 100.

In certain embodiments, the cast-in anchor 100 may include features to help reduce deformation of the housing 108 during the installation process. For example, the housing 108 near the head 104 of the anchor body 112 may include a wider cross section. In particular, the wider cross section may help support impact to the head of the anchor body, making the cast-in anchor 100 more robust against a series of hammering actions or other types of high impact situations or other types of compressive actions. This may help to ensure that the effective embedment depth (e.g., housing component deformation in the vertical direction) is obtained, and will ensure no housing component deformation near the base 118 (e.g., to enable easier threaded rod installation).

FIG. 3 is an exploded view of an embodiment of the cast-in anchor of FIG. 1, where the cast-in anchor includes a removable barrier component 126, as further described with respect to FIG. 7. As illustrated in FIG. 3, the anchor body 112 may be configured to be flush against an inner chamber of the housing 108. It should be noted that having the anchor body 112 flush against the housing 108 may help increase the stability of the cast-in anchor 100 during the installation process. Further, in certain embodiments, the head 104 coupled to the anchor body 112 may include one or more through protrusions that are configured to receive and guide each one of the plurality of fasteners 106 through the head and into the housing 108.

FIG. 4 is a side-view of an embodiment of the cast-in anchor 100 of FIG. 1, where the head 104 of the cast-in anchor 100 contacts the housing 108 in the installed position. In the illustrated embodiment, the cast-in anchor 100 is installed within the wood form 120 and each of the fasteners 106 pass through the housing 108 and into the wood form 120. As noted above, the position of the apex 116 of each fastener 106 above the head 104 of the anchor body 112 helps to distribute the impact force applied to a portion of the head 104 during the installation process. Accordingly, since the impact force is deflected through the cast-in anchor 100, the cast-in anchor 100 is driven into the wood form 120 substantially parallel to the horizontal axis 130 of the anchor body 112. In this manner, the cast-in anchor 100 is properly installed into the wood form 120, and may help reduce accidental displacement after being positioned on the wood form 120 and before the concrete is poured.

FIG. 5 is a cross-sectional view of an embodiment of the cast-in anchor 100 of FIG. 1, where the cast-in anchor 100 includes a multi-thread component 114. In certain embodiments, the cast-in anchor 100 may include a multi-thread component 114 having one or more continuous threads of different sizes. The multi-thread component 114 may be configured to receive construction elements having threaded connection of different sizes, thereby increasing the flexibility of the cast-in anchor 100 to be used with a wide variety of construction elements. For example, the threads may be configured as: ¼"-⅜", ⅜"-½", ⅜"-½"-⅝", ½"-⅝"-¾", or ⅜"-½"-⅝"-¾". In certain embodiments, the construction elements may be pipes, sprinkler systems, HVAC components, conduits, electrical elements, or other similar components that are installed via the cast-in anchor 100. Accordingly, in certain situations, the construction element may be threaded into a desired size and up into a desired location of the multi-thread component 114. The multi-thread component 114 may include diameters of any size and may employ any different combinations of sizes. In certain embodiments, the multi-thread component 114 may include an automatic clamping mechanism having one or more different sizes. For example, the multi-thread component 114 may include a first automatic clamping mechanism 132 and a second automatic clamping mechanism 134. Each of the first and second automatic clamping mechanisms 132 and 134 may allow a differently sized construction element to be pushed into a desired size of the multi-thread component 114, thereby increasing time and efficiency during the installation process.

Figure 6:
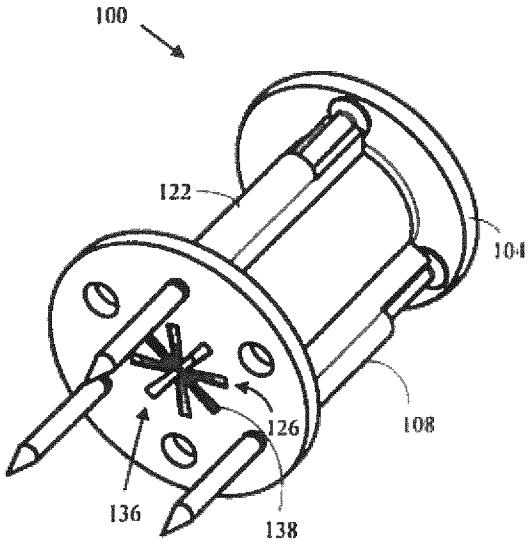
FIG. 6 is a perspective view of an embodiment of the cast-in anchor of FIG. 1, where the cast-in anchor includes a non-removable barrier component.

FIG. 6 is a perspective view of an embodiment of the cast-in anchor 100 of FIG. 1, where the cast-in anchor 100 includes a non-removable barrier component 136 having one or more flexible appendages 138. In particular, the flexible appendages 138 may be configured to prevent the flow of concrete into the multi-thread component 114, or other inner portions of the anchor body 112. The flexible appendages 138 may be formed of a polystyrene, a carton, a rubber, or any material that may be flexible enough to move when a construction element is forced into the multi-thread component 114. In certain embodiments, the non-removable barrier component 136 may be fixed and a component of the base 118 of the housing 108. In other embodiments, the barrier component may be removable, as further described with respect to FIG. 7.

FIG. 7 is a perspective view of an embodiment of the cast-in anchor 100 of FIG. 1, where the cast-in anchor 100 includes a removable barrier component 140. The removable barrier component may be utilized to seal a space between the housing 108 and the multi-thread component 114 of the anchor body 112. In certain embodiments, the removable barrier component 140 may be a removable compressible foam gasket. For example, the removable compressible foam gasket may be attached to the base 118 of the housing 108 with an adhesive and/or other removably attachment feature. In certain embodiments, the removable barrier component 140 may be formed of polystyrene, carton, rubber, or a combination thereof. Prior to installation, the removable barrier component 140 may protrude from the base 118 of the housing 108, and may be in an "uncompressed" or extended form. Prior to installation, the removable barrier component 140 may be positioned to seal the hollow chamber of the anchor body from a flow concrete. In certain embodiments, the removable barrier component 140 may be arranged within an indented location on the exterior surface of the base 118 of the housing 108. During installation, the removable barrier component 140 may be compressible, such that the base 118 of the housing 108 contacts the surface of the installation (e.g., wood form 120). In certain embodiments, the removable barrier component 140 may deform and compress after the fasteners 106 are installed within the wood form 120. In certain embodiments, the removable barrier component 140 may include visual indicia (e.g., color coding, text, and/or numbers) features that enable an operator to distinguish between one or more different types or functions of the cast-in anchors 100. The removable barrier component 140 may be removable feature, and may be configured to prevent ingress of concrete into voids within the cast-in anchor 100, thereby avoiding possible interference when the multi-thread component 114 of the cast-in anchor 100 is utilized.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system, comprising:

an anchor body comprising a head and a hollow chamber shaft coupled to the head;

a housing configured to support the anchor body;

one or more ribs coupled to the anchor body and tapered in a lengthwise direction of the housing; and one or more fasteners supported by the housing, wherein at least one fastener of the one or more fasteners is coupled to the head of the anchor body, and wherein an apex of the at least one fastener is positioned to be above the head of the anchor body.

2. The system of claim 1, wherein the hollow chamber shaft comprises a multi-thread area comprising two or more threads of varying diameters configured to engage a construction surface.

3. The system of claim 1, wherein a bottom surface of the apex of each of the one or more fasteners is adjacent a top surface of the head of the anchor body in a press-fit interference connection, and wherein each of the one or more fasteners is configured to pass through the head of the anchor body.

4. The system of claim 1, wherein each of the one or more fasteners is coupled to the head of the anchor body via a friction fit, an interlock connection, a welded connection, or a threaded connection, or wherein each of the one or more fasteners is bent slightly below the head of the anchor body.

5. The system of claim 1, further comprising a seal configured to seal a gap between the housing and the hollow chamber shaft.

6. The system of claim 5, wherein the seal is a compressible foam gasket.

7. The system of claim 5, wherein the seal comprises a visual indicia configured to uniquely identify the system, and wherein the visual indicia comprises a color, a text, a number, or a combination thereof.

8. The system of claim 5, wherein the seal is configured to be removable to engage and disengage from the gap between the housing and the hollow chamber shaft.

9. The system of claim 5, wherein the seal is a fixed construction and comprises one or more flexible fingers configured to allow a construction surface to pass therethrough.

10. The system of claim 1, wherein the one or more tapered ribs are disposed along a length of the anchor body, and wherein the one or more ribs contact a bottom surface of the head of the anchor body when the system is installed.

11. The system of claim 1, wherein each of the one or more fasteners comprises a nail.

12. The system of claim 1, wherein the head of the anchor body comprises a shape selected from the group consisting of a circular shape, a hexagonal shape, a heptagonal shape, a square shape, a pentagonal shape, an octagonal shape, and any combination thereof.

13. The system of claim 2, wherein the construction surface comprises a pipe, a sprinkler system, an HVAC surface, a conduit, a surface of an area comprising an electrical system, or any combination thereof.

14. The system of claim 1, wherein:

the one or more fasteners comprise a plurality of fasteners, and each of the one or more ribs are disposed along an outer surface of the housing between a respective pair of the plurality of fasteners.

15. The system of claim 1, wherein:

each of the one or more ribs have a bottom width and a top width, and the bottom width is greater than the top width to form the taper in the lengthwise direction of the housing.

16. The system of claim 1, wherein the hollow chamber shaft comprises at least one tapered wall.

17. The system of claim 1, wherein a width of each of the one or more ribs is greater than a distance between each of the one or more fasteners and the hollow chamber shaft.

18. The system of claim 2, wherein the multi-thread area comprises at least one automatic clamping area.

19. The system of claim 18, wherein the multi-thread area comprises a first automatic clamping area having a first size and a second automatic clamping area having a second size different from the first size.

20. The system of claim 1, further comprising:

a non-removable barrier comprising one or more flexible appendages configured to block access into the hollow chamber shaft.

* * * * *